US005549414A

United States Patent [19]

Boxall et al.

[11] Patent Number: 5,549,414

[45] Date of Patent: Aug. 27, 1996

[54] ROAD-SURFACING VEHICLE

[75] Inventors: Godfrey J. Boxall, Wilton; David N. Kilner, Shipley, both of United Kingdom

[73] Assignee: Shell Oil Company, Houston, Tex.

[21] Appl. No.: 360,808

[22] PCT Filed: Jun. 28, 1993

[86] PCT No.: PCT/EP93/01663

§ 371 Date: Feb. 27, 1995

§ 102(e) Date: Feb. 27, 1995

[87] PCT Pub. No.: WO94/00640

PCT Pub. Date: Jan. 6, 1994

[30] Foreign Application Priority Data

Jun. 30, 1992 [EP] European Pat. Off. ..... 93206028

[51] Int. Cl.[6] ..... E01C 19/46

[52] U.S. Cl. ..... 404/101; 404/104; 239/675; 414/508

[58] Field of Search ..... 404/101, 108, 404/110, 104; 239/672, 675; 414/505, 508, 523, 526

[56] References Cited

U.S. PATENT DOCUMENTS

| | | | |
|---|---|---|---|
| 4,215,949 | 8/1980 | Gabriel, Jr. | 404/110 |
| 4,676,689 | 6/1987 | Yant | 404/110 |
| 4,874,283 | 10/1989 | Hurley, Jr. | 404/108 X |

FOREIGN PATENT DOCUMENTS

| | | | |
|---|---|---|---|
| 400759 | 12/1990 | European Pat. Off. | 404/101 |
| 176503 | 3/1991 | Japan | 404/101 |

*Primary Examiner*—Michael Powell Buiz
*Assistant Examiner*—James A. Lisehora

[57] ABSTRACT

A road surfacing vehicle having a controllable articulated distribution head is presented. The distribution head has a material transfer device such as a mixer box pivotally mounted on the vehicle. A laying box is also connected to the material transfer device.

4 Claims, 4 Drawing Sheets

ROAD-SURFACING VEHICLE

FIELD OF THE INVENTION

This invention relates to a vehicle adapted to apply road-surfacing materials.

BACKGROUND OF THE INVENTION

Road-surfacing vehicles are known which comprise a chamber for the material, an outlet and means for mixing the material as it passes to a surface distributor, in the form of a laying box, all of which are an integral part of the vehicle. The laying box will usually be provided at the rear of the vehicle. The road surfacing materials pass out from the laying box onto the road being surfaced.

These vehicles can be used very satisfactorily to surface open areas. However, in view of the limited maneuverability of the vehicles, the application of microasphalt or other road-surfacing materials to curved and confined areas such as lay-bys, bellmouths, hammer heads and road islands, has traditionally been carried out by hand.

By contrast, U.S. Pat. No. 4,215,949 and U.S. Pat. No. 4,676,689 disclose two types of apparatus which are not adapted for surfacing open areas, but which are specifically constructed for patching pavements, i.e. for filling potholes in the surface of an asphalt pavement or roadway. Thus, for example, U.S. Pat. No. 4,215,949 shows a vehicle having a supply hopper mounted along one side which serves to hold a quantity of asphalt. The supply hopper can be lowered to ground level to allow a truck to empty asphalt or other patching material into it through its open top and then raised for transport and use. The vehicle also has a distribution hopper mounted at the end of a remotely controlled arm extending from the front of the vehicle. The arm has a pair of articulated joints which allow the hopper to be positioned over a range of positions by the vehicle operator. The distribution hopper, which has an open top, is filled by placing it under the forward end of the supply hopper. The supply hopper has an auger in it which drives the asphalt forward to be discharged through a downwardly facing opening and into the underlying distribution hopper. The asphalt in he supply hopper is kept warm by the use of a flame inside the auger tube. Once filled, the operator of the vehicle moves the distribution hopper over an area to be repaired and remotely operates a door at the bottom of the distribution hopper, allowing a desired amount of asphalt to be deposited on the roadway. A remotely controlled tamper, mounted on the distribution hopper, then tamps the asphalt in place.

it can readily be appreciated that although the vehicle described in U.S. Pat. No. 4,215,949 would be suited to operating in curved and confined areas, it is only suitable for small scale work (of filling in potholes) and would not be at all suitable for surfacing open areas.

EP-A-0467255 discloses a surface Laying vehicle provided with a distribution head which includes a laying box, the distribution head being slidably mounted for movement in a vertical direction.

GB-A-2216094 discloses a transporting and dispensing truck, provided with a trough which is pivotally mounted about both a horizontal axis and a vertical axis.

SUMMARY OF THE INVENTION

According to the present invention, there is provided a road-surfacing vehicle having an articulated distribution head which comprises material transfer means having first and second ends, and a laying box, wherein the first end of the material transfer means is pivotally mounted on the vehicle and the second end is connected to the laying box; and means for controlling the degree of articulation of the material transfer means relative to the vehicle.

The material transfer means preferably incorporates means for mixing the road-surfacing material, and is preferably a mixer box.

The laying box is typically the same width as the vehicle, e.g. 2 to 3 meters wide, and is connected to the second end of the material transfer means. The laying box may be fixedly connected to the material transfer means, but it is preferred for the second end of the material transfer means to be connected to the laying box by connection means such that the laving box is laterally movable relative to the material transfer means. Suitable such connection means are known per se.

Thus, in a preferred embodiment of the invention, the laying box is connected to the second end of the material transfer means by connection means which enable the laying box to be displaced laterally relative to the material transfer means, and incorporates the maximum shift associated with the above known road-surfacing vehicles in addition to the ability to change the attitude of the laying box with respect to the direction of travel. The ability to rotate the laying box in the horizontal plane increases the effective lateral movement. The combination of movements can be employed to apply material effectively to those areas which traditionally have been surfaced by hand.

The invention will now be further understood from the following detailed description of a preferred embodiment thereof, which is made, by way of example, with reference to the accompanying drawings, in which.

In the drawings, like integers are denoted by like reference numerals.

Figure 1:
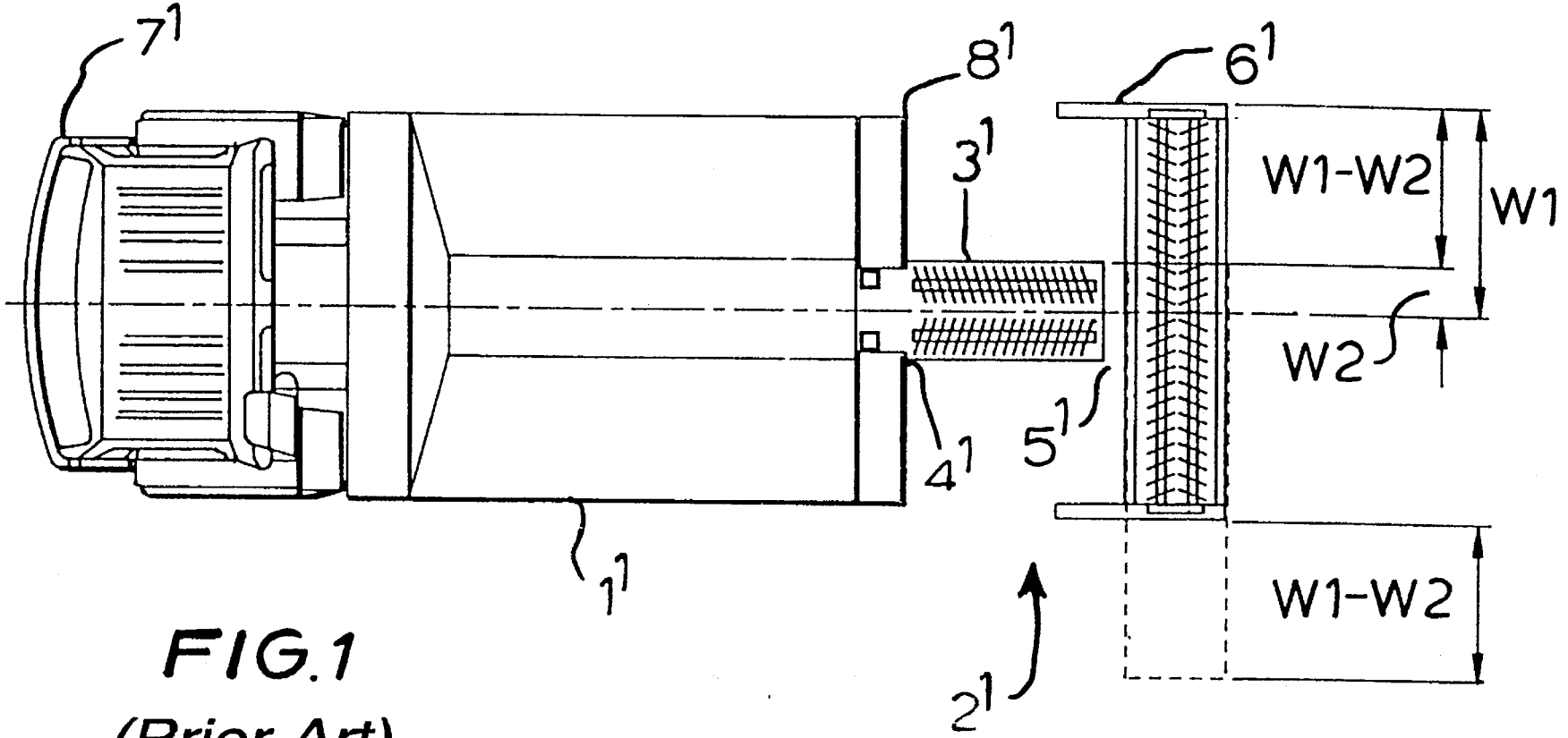
FIG.1 (Prior Art)
FIG. 1 is a schematic plan view of a road-surfacing vehicle known in the art.

FIG. 1 shows a known road-surfacing vehicle 1' with front and rear ends 7' and 8', having a distribution head 2' which comprises a mixer box 3' having first and second ends 4' and 5', and a laying box 6'. The first end 4' of the mixer box 3' is rigidly mounted on the vehicle 1' and the second end 5' is connected to the laying box 6' by connection means such that the laying box 6' is laterally movable relative to the mixer box 3'. The laying box 6' has a width of 2×W1, and has a maximum lateral shift in each direction of W1–W2. In other words, the maximum side-shift movement of the application arrangement is limited to half the width of the arrangement minus half the width of the mixer box 3'.

Figure 2:
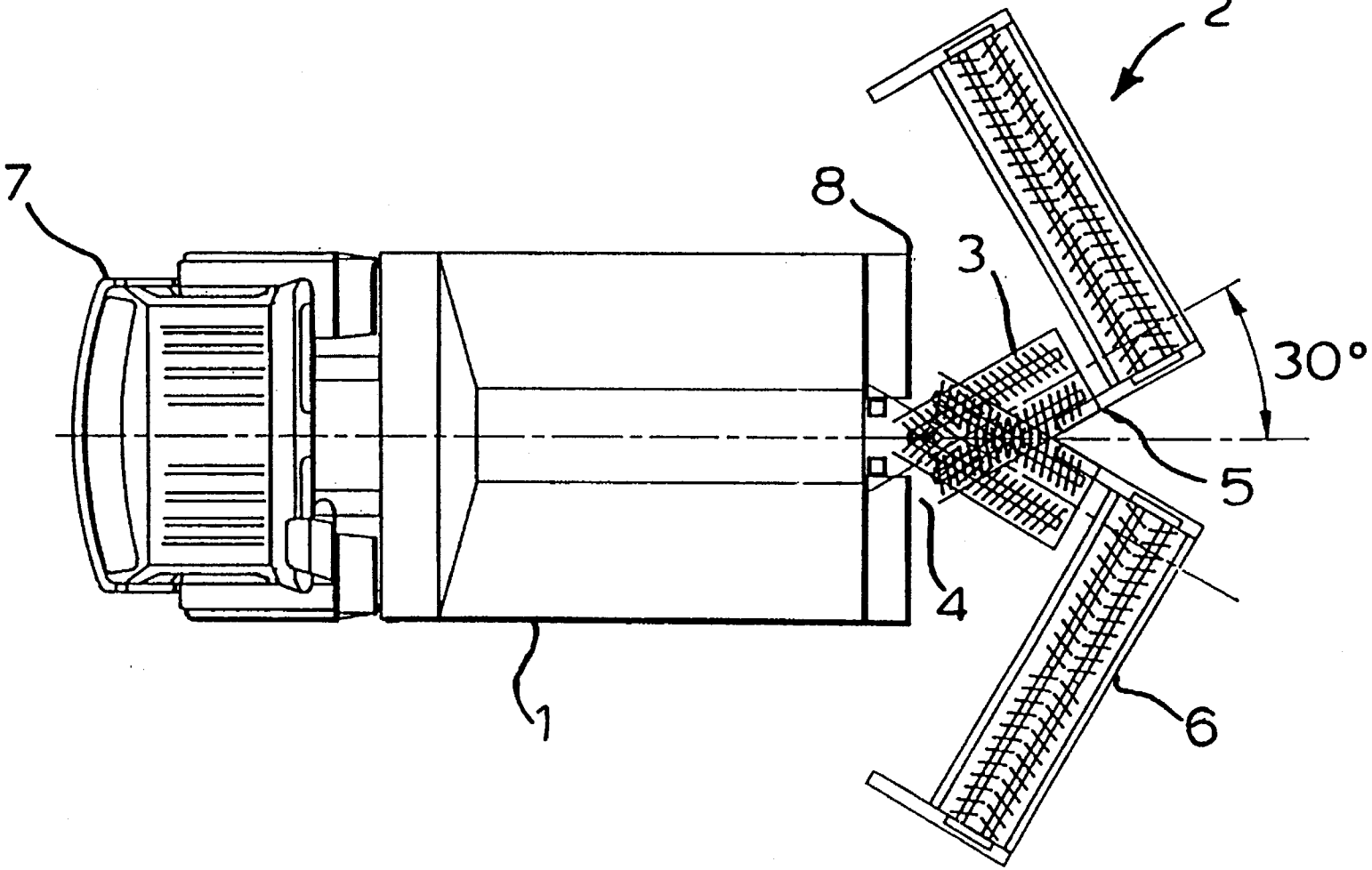
FIG. 2 is a schematic plan view of a vehicle embodying the present invention.

The road-surfacing vehicle according to the present invention which is shown in FIG. 2 may be directly compared to the comparable known arrangement shown in FIG. 1. Thus a road-surfacing vehicle 1 with front and rear ends 7 and 8 has a distribution head 2 which comprises material transfer means in the form of a mixer box 3, having first and second ends 4 and 5, and a surface distributor in the form of a laying box 6 which is substantially the same width as the vehicle 1, e.g. 2 to 3 meters wide. The second end 5 is connected to the laying box 6 in the same way as the second end 5' is connected to the laying box 6' in FIG. 1.

The vehicle 1 according to the invention is characterised in that it has an articulated distribution head 2, wherein the first end 4 of the mixer box 3 is pivotally mounted on the vehicle 1, and, additionally, means (not shown) for controlling the degree of articulation of the mixer box 3 relative to the vehicle 1.

More particularly, FIG. 2 shows articulation of the mixer box 3 and laying box 6 through an angle, e.g. 30°, in each direction with respect to the direction of travel. Each of the illustrated arrangements shows the laying box 6 at its maximum lateral displacement. This indicates clearly the increased lateral coverage available to the operator as well as new attitudes that are available. In the illustrated embodiment, the articulated distribution head 2 is at the rear 8 of the vehicle, but it may alternatively be provided at the front 7.

Figure 3A:
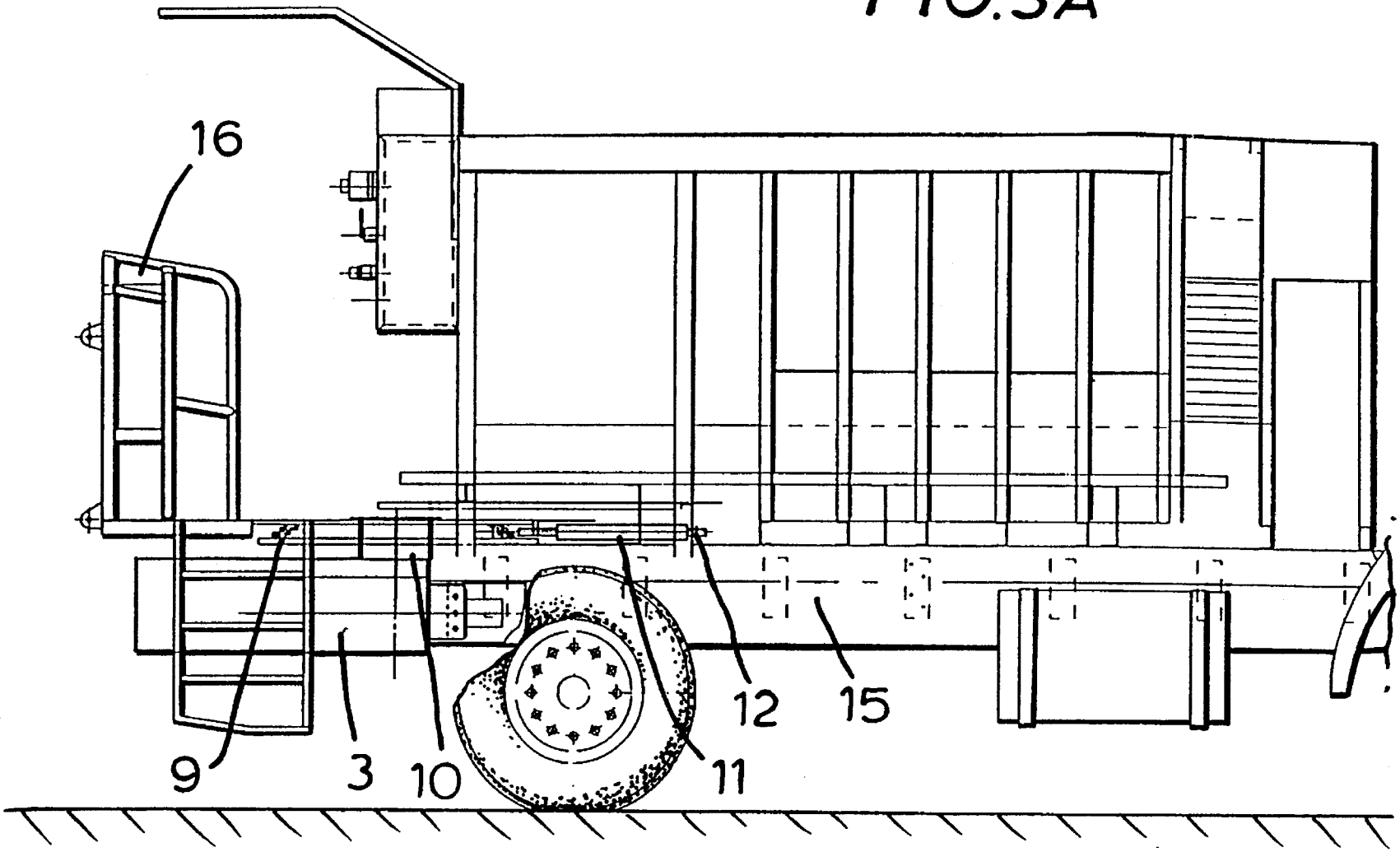
FIGS. 3A and 3B are respectively schematic side and underneath views of part of a vehicle embodying the invention, showing the articulated distribution head in more detail.
Figure 3B:
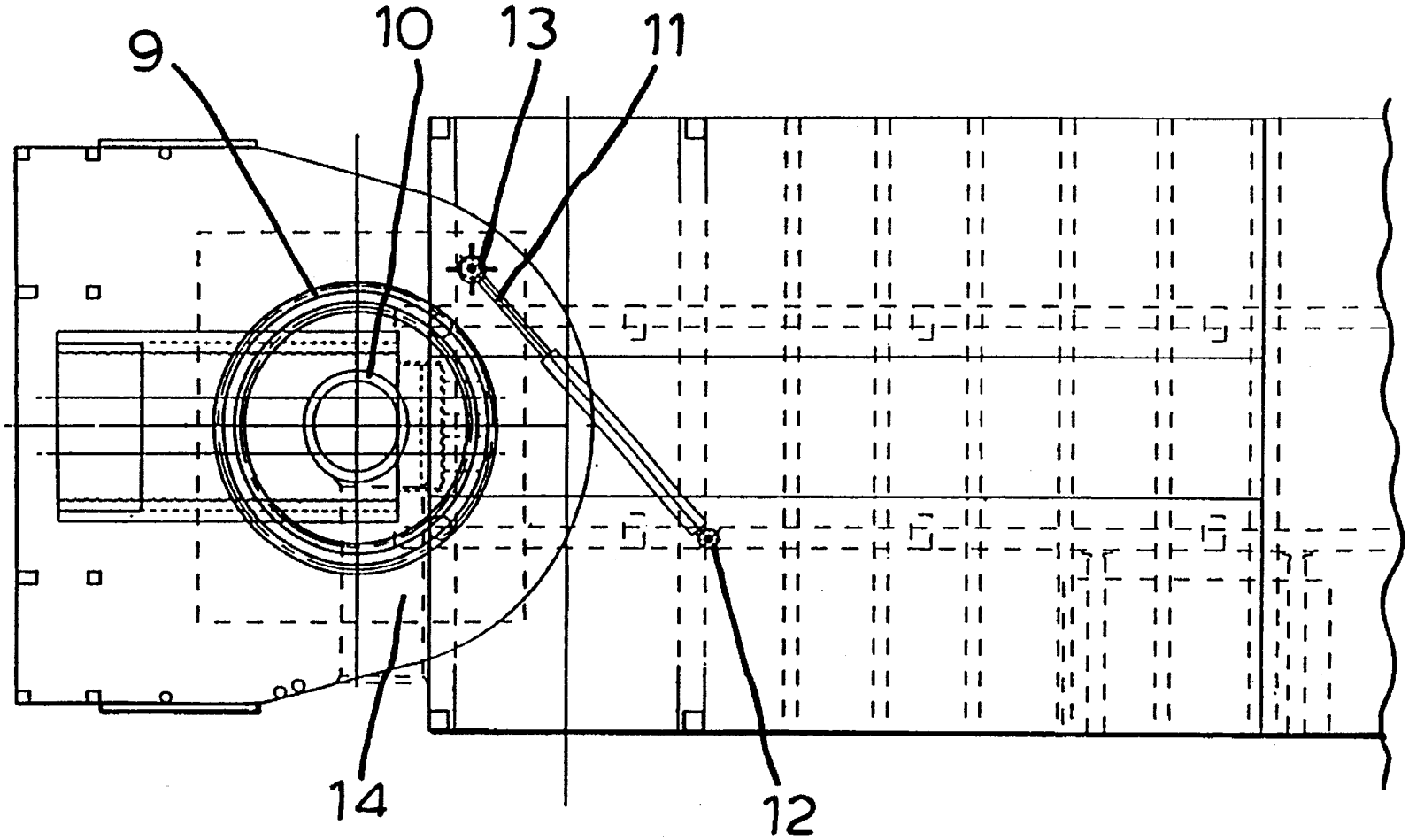

As indicated above, FIGS. 3A and 3B show the articulated distribution head 2 in more detail. It is supported on a ring bearing 9. In use, road-surfacing material is fed to a mixer box 3 via a duct 10, e.g. 500 mm in diameter, whose centre is situated at the centre of articulation, through the bearing 9.

Articulation is controlled by means of a hydraulic cylinder 11 which extends between pivots 12 and 13. The pivot 13 is anchored to a base plate support 14 which is in turn rigidly fixed to the vehicle chasis 15. The degree of articulation may be, as shown in FIG. 2, through an included angle of 60°.

A control console 16 is provided for the operator. This may be a proportional control system, typically electro-hydraulic, enabling the operator to vary the angle of articulation, as well as determining the amount of side-shift applied to the laying box (not shown).

We claim:

1. A road-surfacing vehicle having an articulated distribution head (2) which comprises material transfer means (3) having first and second ends (4, 5), and a laying box (6), wherein the first end (4) of the material transfer means (3) is pivotally mounted on the vehicle and the second end (5) is connected to the laying box (6) such that the laying box (6) is displaced laterally relative to the material transfer means (3); and means (11, 16) for controlling the degree of articulation of the material transfer means (3) relative to the vehicle.

2. A vehicle according to claim 1, wherein the material transfer means (3) incorporates means for mixing the material.

3. A vehicle according to claim 2, wherein the material transfer means (3) is a mixer box.

4. A vehicle according to claim 1, wherein the distribution head (2) is at the rear (8) of the vehicle.

* * * * *